United States Patent [19]
Bayer et al.
[11] 4,318,193
[45] Mar. 9, 1982

[54] FLEXIBLE DEODORANT RING HOLDER

[76] Inventors: Alfred M. Bayer, 2160 Mt. Shasta Dr., San Pedro, Calif. 90732; Norman K. Faulkner, 4651 Northridge Dr., Los Angeles, Calif. 90043; Christine Lasocki, 515 17th St., Huntington Beach, Calif. 92648

[21] Appl. No.: 158,724

[22] Filed: Jun. 12, 1980

[51] Int. Cl.[3] ..... E03D 9/02
[52] U.S. Cl. ..... 4/222; 4/231
[58] Field of Search ..... 4/231, 222, 232, 223

[56] References Cited

U.S. PATENT DOCUMENTS

| | | | |
|---|---|---|---|
| 927,132 | 7/1909 | Duenweld | 4/231 |
| 1,070,108 | 8/1913 | Brittain | 4/231 |
| 1,113,959 | 10/1914 | Danks | 4/231 |
| 1,130,681 | 3/1915 | Albertson | 4/231 |
| 1,145,669 | 7/1915 | Brown | 4/231 |
| 1,411,218 | 3/1922 | Markowsky | 4/222 |

*Primary Examiner*—Henry K. Artis
*Attorney, Agent, or Firm*—Singer & Singer

[57] ABSTRACT

A flexible arcuate shaped holder having an adjustable outside diameter for holding a rigid deodorant ring having a fixed outside diameter in a sink drain is described. The flexible holder is not continuous and has an open segment thereby allowing the outside diameter of the holder to vary from a minimum dimension determined by the outside diameter of the solid deodorant ring to a maximum diameter limited only by the inside diameter of the solid deodorant ring. The flexible outside diameter of the holder allows the deodorant ring to be placed within variable non-standard sink drain openings.

8 Claims, 8 Drawing Figures

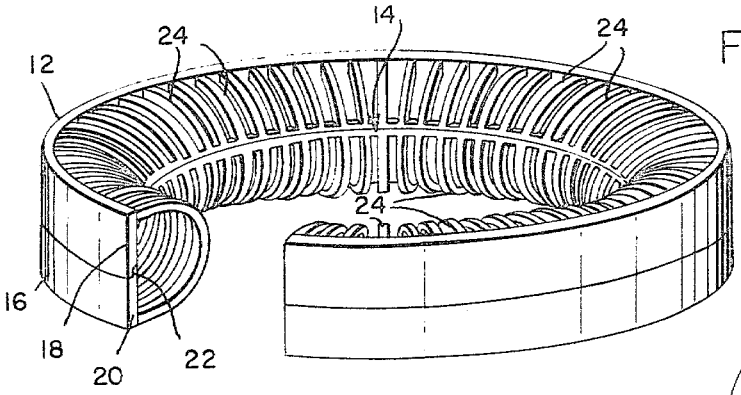
Fig. 1.
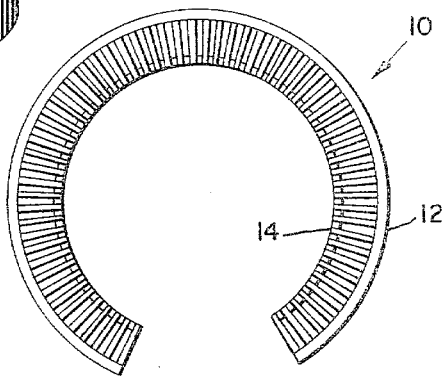
Fig. 2.
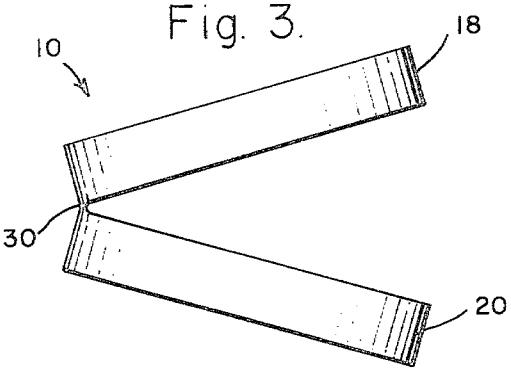
Fig. 3.
Fig. 4.
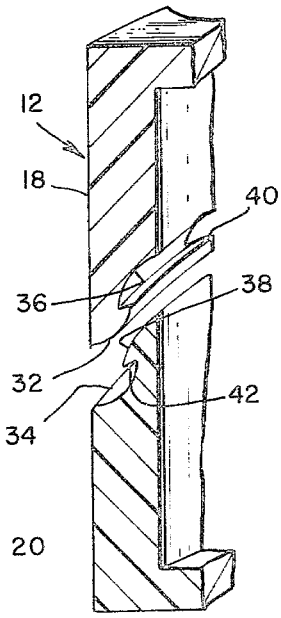
Fig. 5.
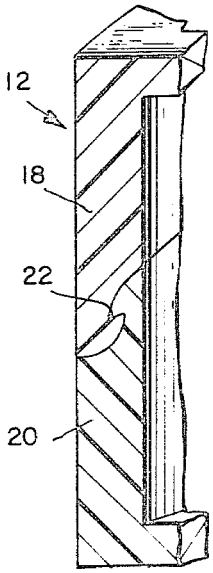
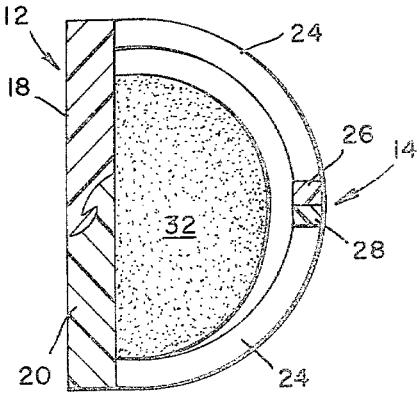
Fig. 8.

FLEXIBLE DEODORANT RING HOLDER

This invention relates to a flexible deodorant ring holder for holding a solid ring of deodorant and more particularly to a flexible holder capable of being used in non-standard sink openings having variable diameter openings.

In today's society it is very common for modern day kitchens to have built-in garbage disposal units that are physically attached to the drain portion of the kitchen sinks.

In practice, garbage scraps and other material are placed into the sink and with the water running all matter is forced into the drain where the garbage disposal grinds the material into a slurry for discharge into the sewer.

In the normal course of events the continuously running water flushes all scraps and garbage into the disposal unit and if used properly the disposal unit will force the slurry into the sewer without leaving any residue. Unfortunately there are many times when the operator of the garbage disposal unit does not use sufficient water to flush away all the garbage or in the alternative garbage is allowed to accumulate in the garbage disposal for periods of time before the unit is operated to flush the garbage slurry away.

During these periods of misuse the stationary garbage tends to ferment and smell, resulting in bacteria around the sink portion that is considered unhealthy and very objectionable to the user.

It is an object of this invention to locate a solid ring of deodorant material of a conventional type well known in the art today and which is not the subject of the present invention in the sink drain opening leading to the garbage disposal unit.

Unfortunately it was soon discovered that the sink drain openings supplied by the individual garbage disposal manufacturers are not standard and may vary from a large opening of a little over 3-7/16" diameter to as small as 3-3/16" diameter.

A ring of deodorant material located in the larger opening so as to form a snug fit would not by definition fit in the smaller openings and conversely a ring adapted to fit in the smaller opening would serve no useful purpose in the larger openings since the deodorant ring would not be held in place and would be eventually destroyed by the bouncing action of the water and the vibration of the garbage disposal unit.

In the present invention these problems are solved by utilizing a flexible deodorant holder having a changeable outside diameter adapted to hold a solid non-flexible deodorant ring.

A flexible arcuate outer rim section forms the outside diameter of the deodorant holder and is adapted to fit into a sink drain in a tight locking configuration by squeezing on the arcuate form to thereby reduce the diameter for insertion purposes.

A plurality of radially extended spaced-apart flexible rib members are each attached to opposite portions along the periphery of the rim section and the non-flexible deodorant ring is located within the flexible members.

Each of the rib members are attached together by a flexible arcuate inner rim section which forms the inside diameter of the deodorant holder. The flexible deodorant holder sized for a 3-7/16" diameter sink drain is actually capable of being reduced in diameter approximately 4/16" thereby allowing a single size solid deodorant ring to accommodate a majority of the various sized sink openings in use today.

In the preferred embodiment the outer rim section has a rectangular cross-section which is placed in contact with the circular sink drain.

In order to make the solid deodorant rings replaceable, the outer rim section is split into two halves and the inner rib section is split into two halves, thereby allowing both halves to be separated and a new deodorant ring to be inserted when necessary.

In the preferred embodiment the split outer rim sections have complimentary mating surfaces for removably locking both halves together while at the same time the inner rim section is split into two halves that simply abut each other to maintain the deodorant ring in position.

The deodorant ring is preferably shaped in a semi-circular cross-section for maximizing the amount of deodorant capable of being held by the flexible deodorant ring holder.

Further objects and advantages of the present invention will be made more apparent by referring now to the accompanying drawings wherein:

FIG. 1 is a perspective view of the flexible deodorant ring holder;

FIG. 2 is a top plan view of the deodorant ring holder illustrated in FIG. 1;

FIG. 3 is a side view of the deodorant ring holder illustrating the split outer rim attached together by a hinge portion;

FIG. 4 is an exploded view of the outer rim member illustrating the complimentary mating surfaces for locking both halves together;

FIG. 5 illustrates the split outer rim locked together;

FIG. 8 is a cross-section of FIG. 7 taken along lines 8—8.

Figure 6:
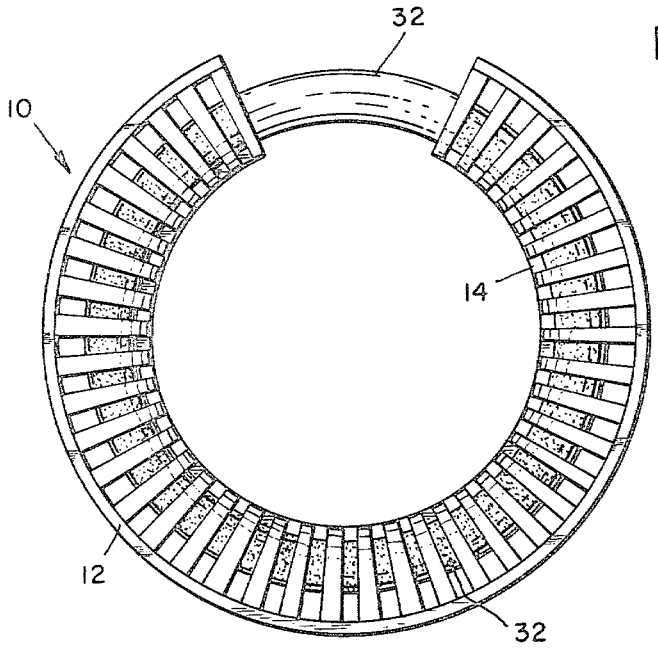
FIG. 6 illustrates the flexible ring holder about a solid deodorant ring for use in the largest sized sink drain.

Referring now to FIG. 1, there is shown a perspective view of a flexible deodorant ring holder 10 consisting of an arcuate flexible outer rim 12 and an arcuate flexible inner rim 14.

The outer rim 12 has a substantially rectangular cross-section and is adapted to be placed in a sink holder with the outside surface 16 contacting the inside diameter of conventional sink drain not illustrated.

In the preferred embodiment the outer rim 12 ia constructed of two halves 18 and 20 that are adapted to be locked together by complimentary surfaces 22 more fully illustrated in connection with FIGS. 4 and 5.

A plurality of radially extending spaced-apart flexible rib members 24 are each attached to opposite portions of the substantially rectangular outer rim 12. The rib members 24 are each attached to the flexible inner rim 14 thereby making a single encompassing structure for holding a solid deodorant ring.

In the preferred embodiment the arcuate flexible inner rim 14 is actually split into two halves 26 and 28 each having a substantially rectangular cross-section abutting each other.

In this fashion the flexible deodorant ring holder may be separated into two halves for replacing the solid deodorant ring when necessary.

Referring now to FIG. 2, there is shown a top plan view of the flexible deodorant ring holder illustrating the spaced-apart rib members 24 which allows the flushing liquid water to pass through the openings and contact the solid deodorant ring located within the holder. The arcuate shape of the outer rim 12 and the inner rim 14 more fully illustrates how the ring holder may be compressed to reduce the outside diameter and thereby make the holder adaptable for different sized sink drain openings while at the same time utilizing a single sized deodorant ring holder. This feature is more fully illustrated in connection with FIGS. 6 and 7.

Referring now to FIG. 3, there is shown a preferred embodiment of the split rim deodorant ring holder illustrating one-half of the outer rim 18 flexibly attached by means of a hinge portion 30 to the other one-half of the outer rim portion 20. The hinge section 30 is preferably constructed of the same material as the flexible outer rim 12 and the inner rim 14 and acts as a convenient means for holding both rims together when replacing a new solid deodorant ring.

Referring now to FIG. 4, there is illustrated an exploded view of both halves of the outer rim 18 and 20 in a spaced-apart relationship more fully illustrating the complimentary mating surfaces 22.

Exterior surface 32 on rim 18 is complimentary to internal surface 34 on rim 20. In a similar fashion interior surface 36 on rim 18 is complimentary to outer surface 38 on rim 20.

The transition on rim 18 from exterior surface 32 to interior surface 36 provides a shoulder 40 that compliments the transitional curve on rim 20 from interior surface 34 to exterior surface 38 which forms a shoulder 42 that compliments and locks with shoulder 40 on rim 18.

In the preferred embodiment the outer rim 14 comprising ribs 18 and 20 are constructed of plastic material thereby allowing shoulders 40 and 42 to be easily latched together and thereby lock both halves of the ring holder in a closed relationship.

Referring now to FIG. 5, there is shown an exploded view of rim 18 locked together with rim 20 by means of the complimentary mating surfaces 22.

Figure 7:
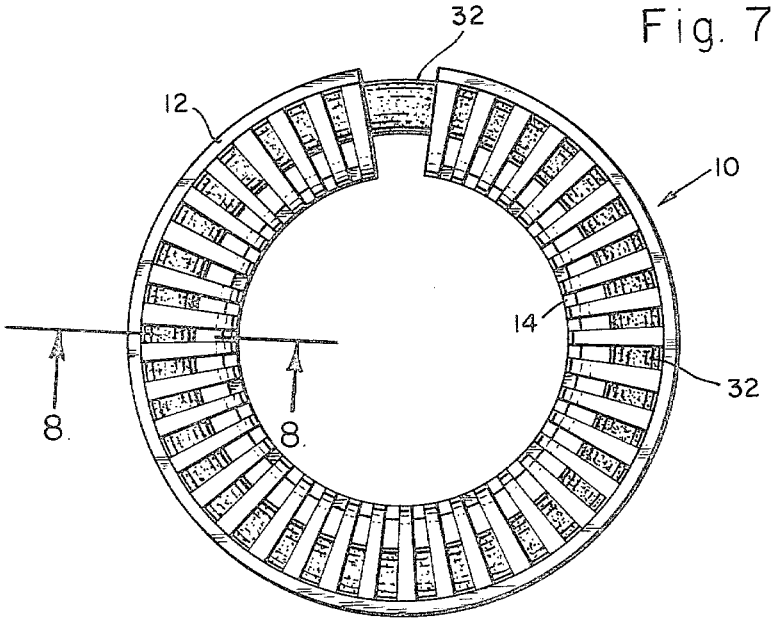
FIG. 7 illustrates the flexible ring holder about the same solid deodorant ring for use with the smallest sized sink drain.

Referring now to FIGS. 6 and 7, there is shown a given sized solid deodorant ring 32 located within a flexible deodorant ring holder 10.

In FIG. 6 the arcuate flexible ring holder is expanded to its largest diameter as determined by the internal diameter of the deodorant ring 32. In this position the arcuate inner rim 14 is in contact with the inside diameter of the solid deodorant ring and the outside diameter of the ring holder is at a maximum. In the preferred embodiment the ring holder will accept a sink drain having an opening of at least 3-7/16" in diameter. Experience has indicated that this is the largest sink opening supplied by one of the major suppliers of garbage disposal units for household installations.

A review of FIG. 7 will show the same size solid deodorant ring 32 located within the same deodorant ring holder 10 but in this case the ring holder is compressed to its smallest outside diameter. In this configuration the smallest size is limited by the outside diameter of the solid deodorant ring which is in contact with the arcuate flexible outer rim 12 of the ring holder. With the same size solid deodorant ring 32 it is now possible to compress the ring holder to a size of approximately 3-3/16" diameter which is approximately the size of the smallest sink drain opening supplied by still another major supplier of disposal units for the home.

Referring now to FIG. 8, there is shown a cross-sectional view of the ring holder taken along lines 8—8 of FIG. 7 and which more fully illustrates the locking mechanism 22 and the solid deodorant ring 32 located within the deodorant ring holder 10. In the preferred embodiment it is most desirous to increase the volume of deodorant held by the ring holder and to this end a deodorant ring having a substantially semi-circle cross-sectional area is preferred. Rim 18 and rim 20 are shown locked together by complimentary mating surfaces 22 thereby holding both halves in a closed relationship. The advantages of the present invention allow the manufacturer to utilize a single size deodorant ring either in a non-replaceable flexible ring holder or in a replaceable flexible ring holder that is easily opened and closed to allow the deodorant ring to be replaced as needed. We claim:

1. A flexible holder having a changeable outside diameter for holding a solid non-flexible deodorant ring comprising:

a flexible arcuate outer rim section having a straight outer side forming the outside diameter of a deodorant holder adapted to fit into a sink drain thereby forming a flexible holder having a semi-circular cross-section, a plurality of radially extending spaced-apart flexible rib members each attached to opposite portions of said straight outer side along the periphery of said rim section, and each of said rib members attached together by a flexible arcuate inner rim section forming the inside diameter of the deodorant holder.

2. A flexible holder according to claim 1 in which said outer rim section has a substantially rectangular cross-section and in which each of said rib members is attached to opposite ends of said rectangular cross-section rim section.

3. A flexible holder according to claim 1 in which said outer rim section is split into two halves and said inner rim section is split into two halves thereby allowing deodorant rings to be replaced.

4. A flexible holder according to claim 3 in which said split outer rim sections have complimentary mating surfaces for removably locking both halves together.

5. A fexible holder according to claim 3 which includes a tab connecting both halves of the split outer rim together as a hinge.

6. A flexible holder according to claim 3 in which the cross-section of each split inner rim section is a square whereby each square abuts the other in the closed configuration.

7. A flexible holder according to claim 1 in which the cross-section of the solid deodorant is semi-circular for maximizing the amount of deodorant in the holder.

8. A flexible holder according to claim 1 in which the arcuate outer rim section and the arcuate inner rim section are formed into a circular non-touching shape and in which the spaced-apart outer rim determines the largest outside diameter of the holder.

* * * * *